US011470930B2

(12) United States Patent
Zajac et al.

(10) Patent No.: US 11,470,930 B2
(45) Date of Patent: Oct. 18, 2022

(54) ADJUSTABLE SIZE SUITCASE

(71) Applicants: Christopher Zajac, South Windsor, CT (US); Marlon Fuller, Winter Garden, FL (US)

(72) Inventors: Christopher Zajac, South Windsor, CT (US); Marlon Fuller, Winter Garden, FL (US)

( * ) Notice: Subject to any disclaimer, the term of this patent is extended or adjusted under 35 U.S.C. 154(b) by 189 days.

(21) Appl. No.: 16/535,839

(22) Filed: Aug. 8, 2019

(65) Prior Publication Data

US 2020/0046093 A1 Feb. 13, 2020

Related U.S. Application Data

(60) Provisional application No. 62/716,226, filed on Aug. 8, 2018.

(51) Int. Cl.

| | |
|---|---|
| ***A45C 7/00*** | (2006.01) |
| ***A45C 5/03*** | (2006.01) |
| ***A45C 13/04*** | (2006.01) |
| ***A45C 5/14*** | (2006.01) |
| ***A45C 5/06*** | (2006.01) |
| ***A45C 13/26*** | (2006.01) |

(52) U.S. Cl.

CPC ..... *A45C 7/0031* (2013.01); *A45C 5/03* (2013.01); *A45C 5/06* (2013.01); *A45C 5/14* (2013.01); *A45C 13/04* (2013.01); *A45C 13/262* (2013.01); *A45C 2013/267* (2013.01)

(58) Field of Classification Search

CPC .... A45C 7/0031; A45C 7/00; A45C 2005/035

USPC ..... 190/103

See application file for complete search history.

(56) References Cited

U.S. PATENT DOCUMENTS 672,143 A * 4/1901 Boughner ..... A45C 7/0031 190/104
4,361,215 A * 11/1982 Sawai ..... A45C 7/0027 190/103
5,307,908 A * 5/1994 Shyr ..... A45C 5/14 190/111

(Continued)

FOREIGN PATENT DOCUMENTS

CA 2936342 A1 * 1/2018 ..... A45C 5/03

*Primary Examiner* — John K Fristoe, Jr.
*Assistant Examiner* — Justin Caudill
(74) *Attorney, Agent, or Firm* — Jason T. Daniel, Esq.; Daniel Law Offices, P.A.

(57) ABSTRACT

An adjustable size suitcase includes a main body having a top section, a middle section and a bottom section that define a hollow interior space. A telescopic handle extends upward from the main body and a plurality of omnidirectional wheels are positioned along the bottom end of the main body. A frame is positioned within the hollow interior space of the main body and includes an upper frame assembly, a middle frame assembly and a lower frame assembly. The upper frame assembly includes a plurality of vertical frame members that are slidingly engaged to complementary located lower vertical frame members to permit vertical movement of the upper frame assembly relative to the lower frame assembly. An actuator is mechanically linked to a plurality of latches positioned within the bottom ends of each upper vertical frame member to selectively transition the suitcase between a first, second and third size.

10 Claims, 6 Drawing Sheets

(56) References Cited

U.S. PATENT DOCUMENTS

| | | | | | |
|---|---|---|---|---|---|
| 5,664,652 | A * | 9/1997 | Shamah | A45C 5/14 | 190/103 |
| 5,694,663 | A | 12/1997 | Tserng | | |
| 5,819,891 | A * | 10/1998 | Wang | A45C 13/262 | 190/103 |
| 6,059,078 | A * | 5/2000 | Nykoluk | A45C 5/14 | 190/103 |
| 6,109,403 | A * | 8/2000 | Godshaw | A45C 5/14 | 190/113 |
| 6,179,101 | B1 * | 1/2001 | Lin | A45C 13/262 | 190/103 |
| 6,899,346 | B2 | 5/2005 | Pfeiffer | | |
| 7,232,018 | B1 * | 6/2007 | Salander | A45C 5/14 | 190/103 |
| 2002/0125669 | A1 * | 9/2002 | Chang | A45C 5/14 | 190/18 A |
| 2015/0374086 | A1 * | 12/2015 | Yun | A45C 7/0036 | 190/18 A |
| 2017/0174393 | A1 * | 6/2017 | Casey | B65D 5/441 | |

* cited by examiner

ADJUSTABLE SIZE SUITCASE

CROSS-REFERENCE TO RELATED APPLICATIONS

This application claims the benefit of U.S. Application Ser. No. 62/716,226 filed on Aug. 8, 2018, the contents of which are incorporated herein by reference.

TECHNICAL FIELD

The present invention relates generally to travel and storage bags, and more particularly to a suitcase having a size that can be adjusted by a user.

BACKGROUND

The statements in this section merely provide background information related to the present disclosure and may not constitute prior art.

Luggage such as suitcases, duffel bags and hard sided cases, for example, have been utilized for decades to protect and transport the personal belongings of travelers. In this regard, manufacturers produce luggage in a wide variety of different shapes, sizes and styles, to suit the needs of the traveling public. Within this arena, there are two primary types of luggage: "carry-on" or "full-size".

As the name implies, "carry-on" luggage is designed to conform to airline standards so as to be carried by a traveler onto an aircraft. Conversely, "full-size" luggage is larger, and is designed to be transported by the carrier directly via the baggage handling system. Among the full-size luggage category, there are medium sized bags and large bags. Recent and dramatic increases in fees associated with luggage sizes have caused much of the traveling public to think carefully before utilizing a full-sized bag. Moreover, in some cases a user may only need the larger sized bag for a portion of their trip and would prefer to use a carry-on bag for one leg of a trip.

Accordingly, it would be beneficial to provide an adjustable sized suitcase that can allow a single piece of luggage to transform between the industry standard "carry-on" size and a "full-sized" bag, so as to overcome the drawbacks described above.

SUMMARY OF THE INVENTION

The present invention is directed to an adjustable size suitcase. One embodiment of the present invention can include a main body having a top section, a middle section and a bottom section that define a hollow interior space. A telescopic handle extends upward from the main body and a plurality of omnidirectional wheels are positioned along the bottom end of the main body.

In one embodiment, a frame is positioned within the hollow interior space of the main body and includes an upper frame assembly, a middle frame assembly and a lower frame assembly. The upper frame assembly includes a plurality of vertical frame members that are slidingly engaged to complementary located lower vertical frame members to permit vertical movement of the upper frame assembly relative to the lower frame assembly.

In one embodiment, a grip is positioned centrally along the upper frame assembly. The grip can include an actuator that is mechanically linked to a plurality of latches within the upper vertical frame members to selectively transition the suitcase between a first, second and third size.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1C:
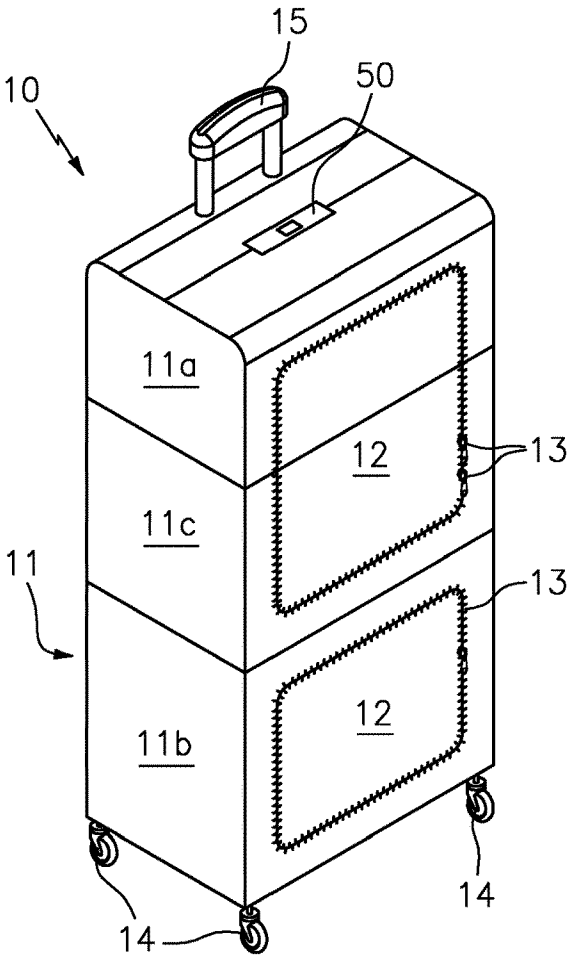
FIG. 1C is a perspective view of the adjustable size suitcase in the large position, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "adjustable-length member" can include the ability of a component to expand and contract in length, width and/or height. This can be accomplished through any number of conventional items such as telescoping rods, for example, having a tensioning or locking mechanism to maintain the device in a desired position.

Although described throughout this document as transitioning between an industry standard airline "carry-on", medium and large and "full-sized" suitcase, this is for illustrative purposes only. To this end, those of skill in the art will recognize that the inventive concepts disclosed herein can be applied to any type of container, regardless of shape, size, design or intended use without undue experimentation.

Accordingly, the inventive concepts are not to be construed as limiting to luggage and/or to a specific shape or sized bag.

As described herein, the terms "connector" and "complementary connector" include any number of different elements that work together to repeatedly join two items together in a nonpermanent manner. Several nonlimiting examples include opposing strips of hook and loop material (i.e. Velcro®), attractively-oriented magnetic elements, flexible strips of interlocking projections with a slider (i.e., zipper), tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

FIGS. 1A-6 illustrate one embodiment of an adjustable size suitcase 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure.

Figure 1B:
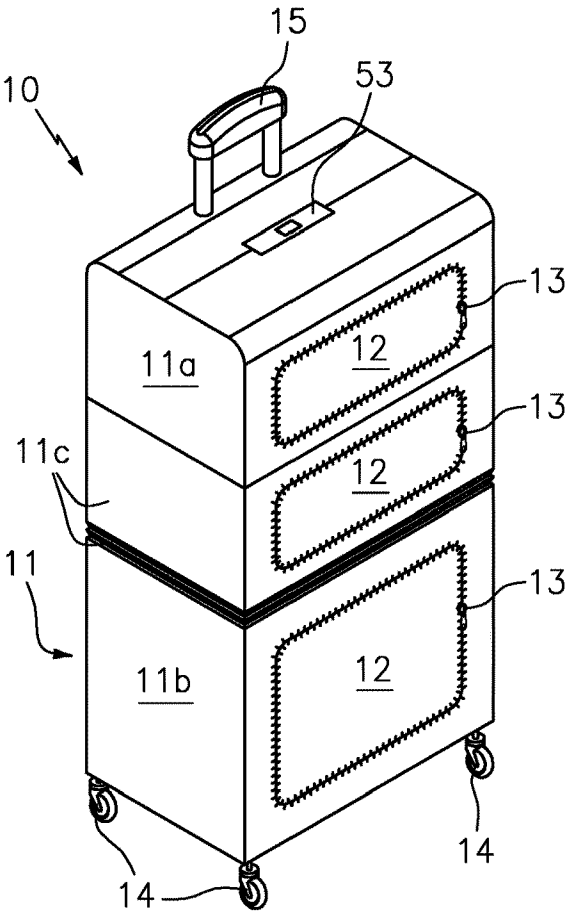
FIG. 1B is a perspective view of the adjustable size suitcase in the medium position, in accordance with one embodiment of the invention.
Figure 1A:
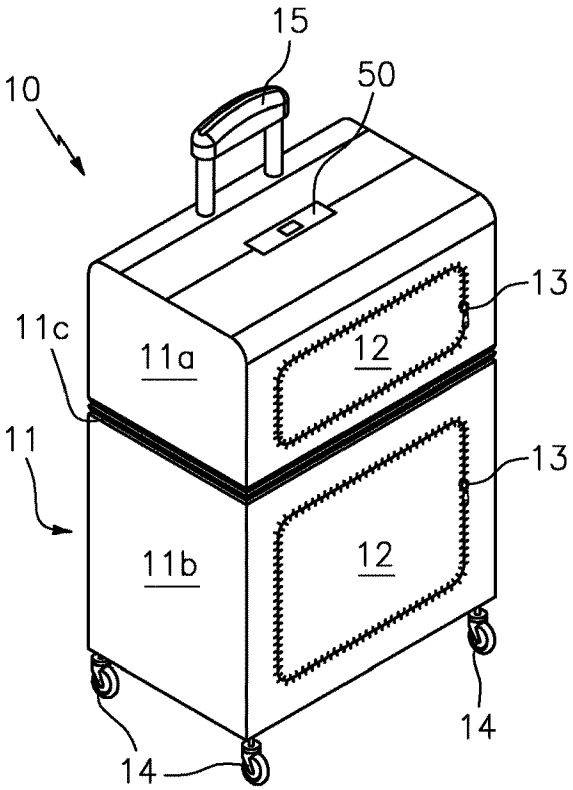
FIG. 1A is a perspective view of the adjustable size suitcase in the carry-on position, in accordance with one embodiment of the invention.

For purposes of this description, the terms "upper," "bottom," "right," "left," "front," "vertical," "horizontal," and derivatives thereof shall relate to the invention as oriented in FIG. 1A.

As shown at FIGS. 1A, 1B and 1C, the suitcase 10 can transition from a small carry-on sized bag to a medium and a large full-sized suitcase, respectively. In this regard, the device 10 can include a generally hollow main body 11, having an internally located adjustable frame 20.

In one embodiment, the main body 11 can include a top section 11*a*, a bottom section 11*b*, and a collapsible middle section 11*c* that surround the frame 20 and form an interior space. In the preferred embodiment, the entire main body 11 can be constructed from a generally malleable material such as polyester, nylon or leather, for example; however other embodiments are contemplated wherein the top and bottom sections are constructed from non-resilient materials such as various plastics or aluminum, for example.

Access to the interior of the suitcase can be accomplished by any number of flaps 12 which can be positioned along the main body and can be selectively opened and closed via a connector 13 such as a zipper, for example. In the preferred embodiment, the flaps and connectors positioned along the top and middle sections can be joined together so as to operate as a single unit when the bag 10 is in the fully expanded large size shown at FIG. 1C.

In various embodiments, a plurality of fixed or omnidirectional wheels 14 can be positioned along the bottom end of the suitcase, and a handle 15 can be positioned along the top back side of the suitcase. In the preferred embodiment, the handle can be telescopic in nature as is known in the art. One suitable example of a telescoping suitcase handle for use herein is described in U.S. Pat. No. 5,694,663 to Tserng, the contents of which are incorporated herein by reference.

Figure 2:
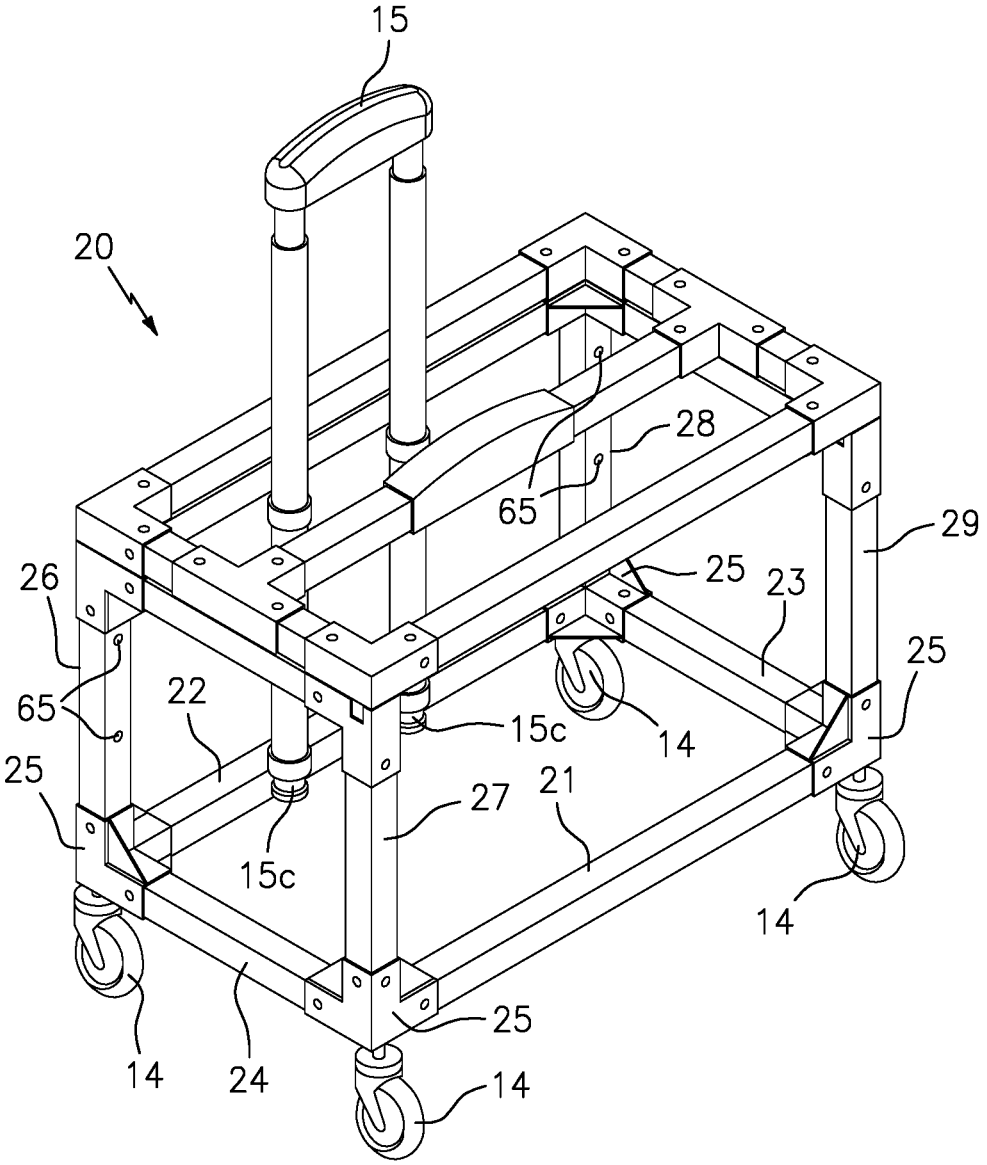
FIG. 2 is a perspective view of the frame of the adjustable size suitcase in the carry-on position, in accordance with one embodiment of the invention.
Figure 3:
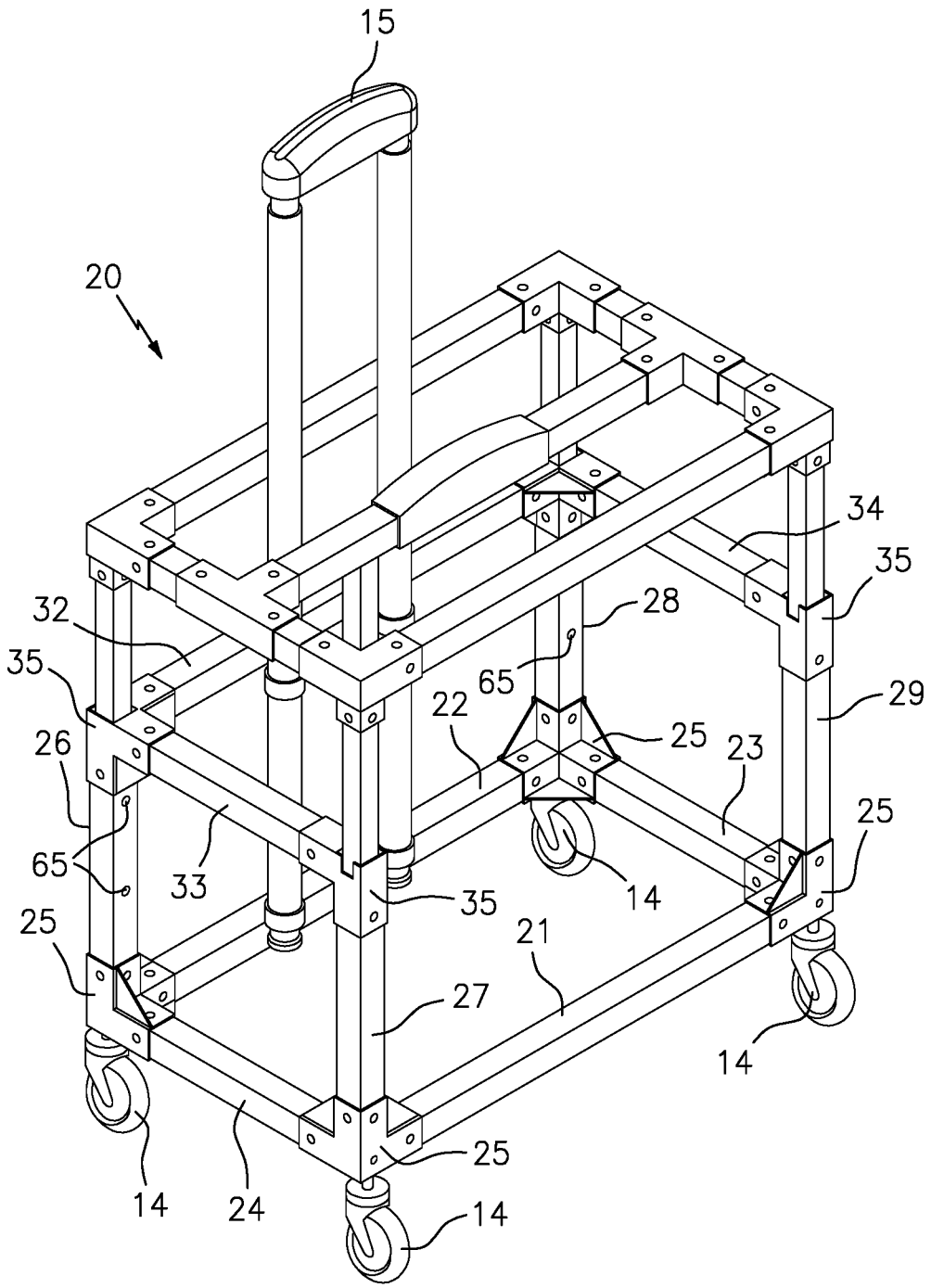
FIG. 3 is a perspective view of the frame of the adjustable size suitcase in the medium position, in accordance with one embodiment of the invention.
Figure 4:
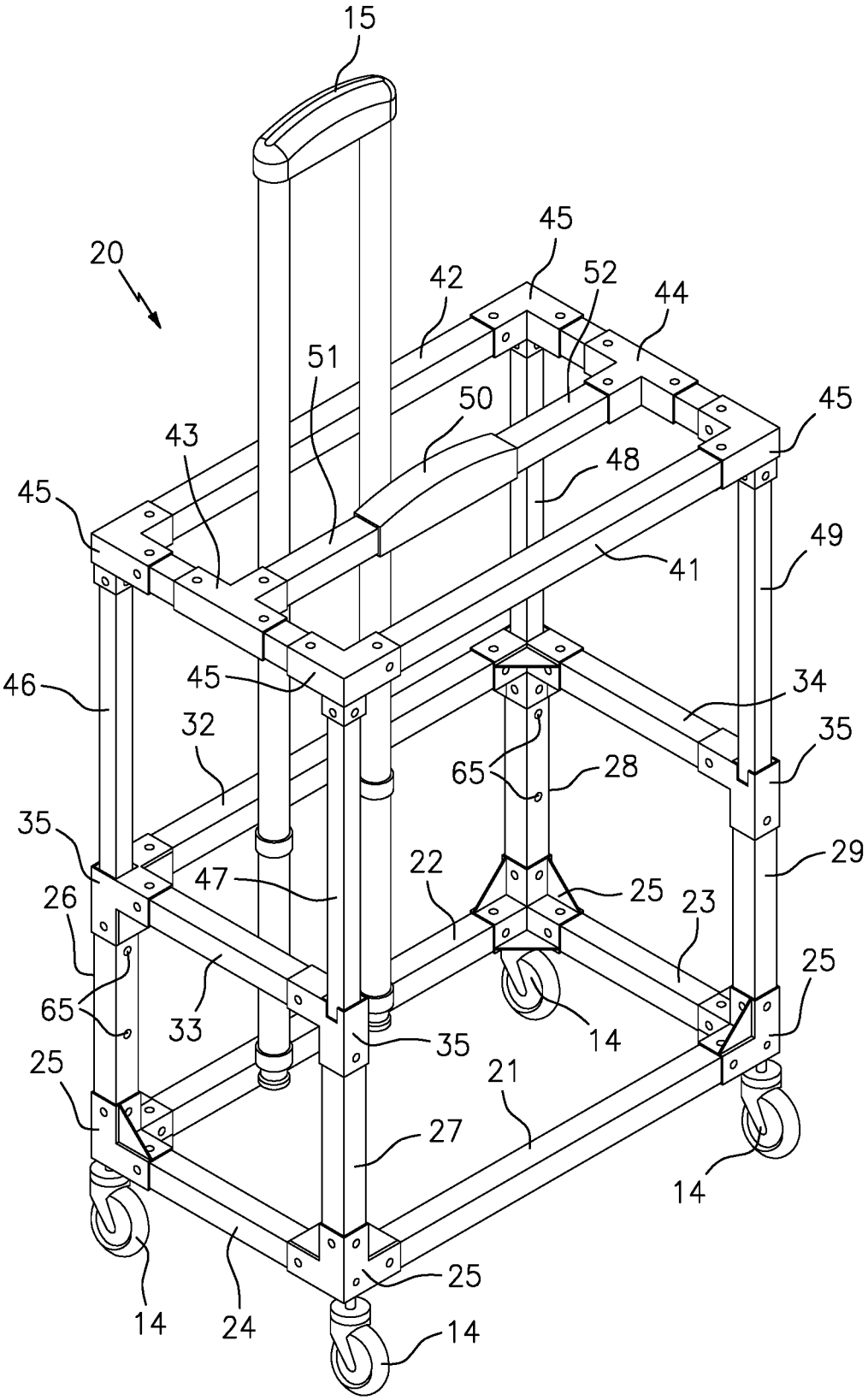
FIG. 4 is a perspective view of the frame of the adjustable size suitcase in the large position, in accordance with one embodiment of the invention.

FIGS. 2-4 illustrate one embodiment of the suitcase 10 in the carry-on, medium and large configurations, respectively, wherein the main body 11 is removed for ease of reference. As shown, the adjustable frame 20 can include a lower frame assembly, a middle frame assembly and an upper frame assembly.

As shown best in FIG. 2, the adjustable frame 20 can include a lower frame assembly having both a horizontal frame section and a vertical frame section. In one embodiment, the lower horizontal frame section can include a front lower frame member 21, a back lower frame member 22, and a pair of side lower frame members 23 and 24 that are each joined along the distal end via sleeve receivers 25. The bottom of the frame can receive each of the wheels 14 and the back lower frame member 22 can engage the bottom end 15*c* of the telescoping handle 15.

In one embodiment, the lower vertical frame section can include four vertical frame members 26, 27, 28 and 29 which extend upward from the sleeve receivers 25. Each of the vertical frame members can be constructed from hollow tubing and can include a plurality of apertures 65 that are positioned at complementary locations along each frame. As will be described below, the apertures can be engaged by a latch to allow the upper portion of the frame to move relative to the lower frame assembly.

As shown best at FIG. 3, one embodiment of the middle frame assembly can include a horizontal frame section having a back middle frame member 32, and a pair of side middle frame members 33 and 34 that are positioned in a parallel orientation with the lower horizontal frame section and in communication with the lower vertical frame section via additional sleeve receivers 35. The back-middle frame member 32 can engage the middle end 15*b* of the telescoping handle 15.

As shown best at FIG. 4, the upper frame assembly can include both an upper horizontal frame section and an upper vertical frame section. In one embodiment, the upper horizontal frame section can include a front upper frame member 41, a back upper frame member 42, and a pair of side upper frame members 43 and 44 that are secured via sleeve receivers 45. The upper horizontal frame section is in a parallel orientation with the lower horizontal frame section and the middle frame section.

In one embodiment, the upper vertical frame section can include four vertical frame members 46, 47, 48 and 49 that extend down from the sleeve receivers 45. Each of the vertical frame members 46-49 can be constructed from hollow tubing and can include an outside dimension that is less than the inside dimension of the lower vertical frame members so as to be slidingly positioned within the upper ends of the lower vertical frame members 26-29, respectively.

A grip 50 is positioned centrally along the upper frame section and is supported by central frame members 51 and 52 that terminate into the pair of side upper frame members 43 and 44, respectively.

Figure 5:
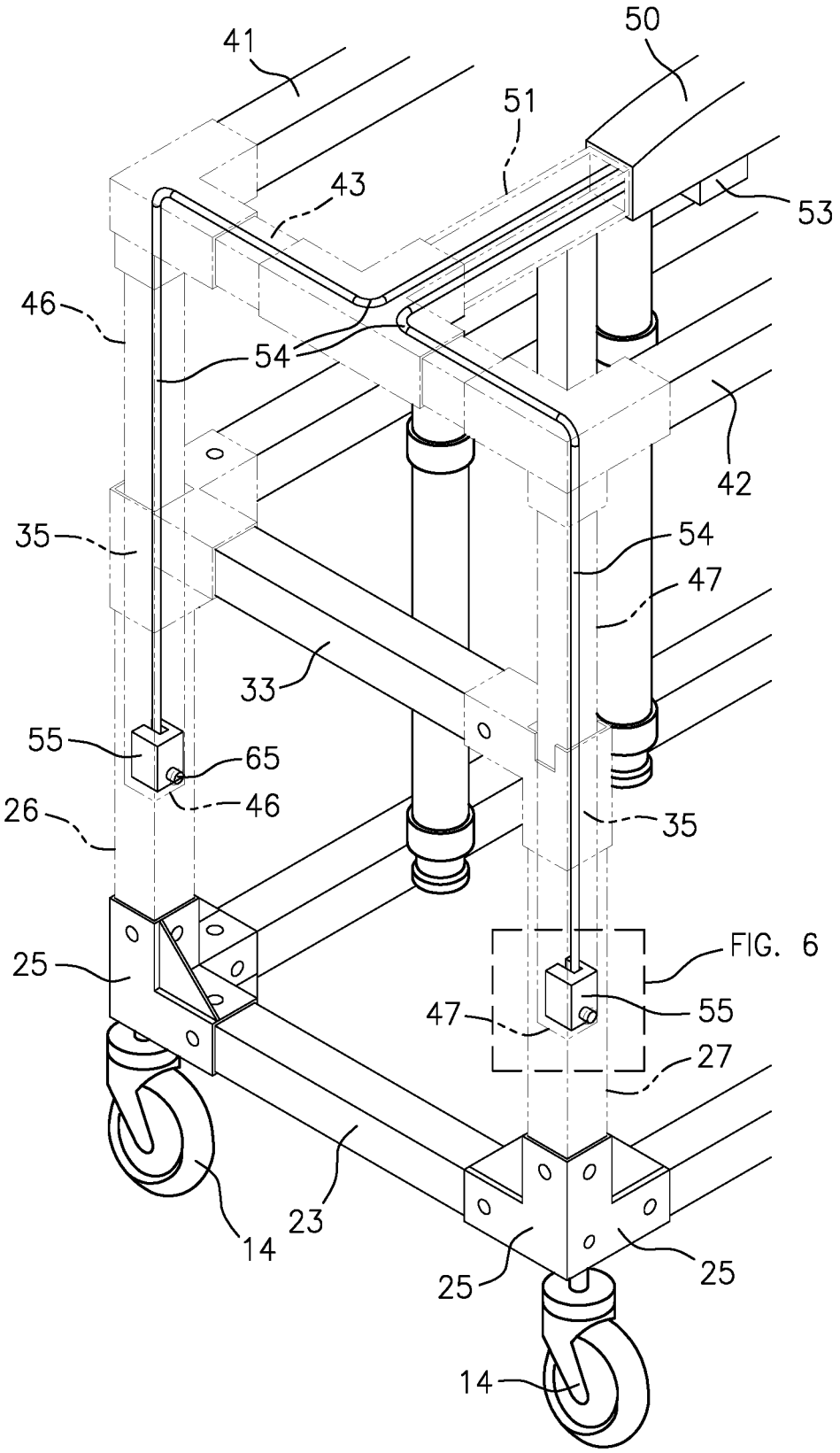
FIG. 5 is a partial cross-sectional cutout view of the frame of the adjustable size suitcase in accordance with one embodiment of the invention.

As shown in the partial cross-sectional cutout view of FIG. 5, an actuator 53 such as a spring biased button, for example can be positioned along the grip 50. The actuator can be connected to a plurality of links 54 such as metallic cables, for example, that travel through the upper frame members and terminate at latches 60 positioned along the bottom ends of the vertical frame members 46-49.

Figure 6:
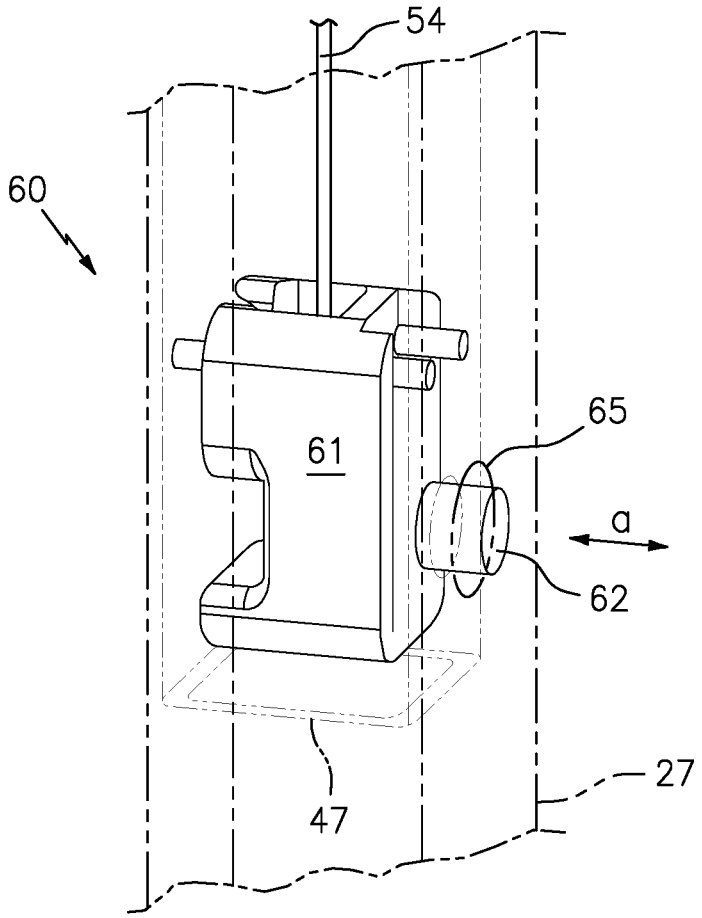
FIG. 6 is a cutout view of the latch of the adjustable size suitcase in accordance with one embodiment of the invention.

As shown in the cutout view of FIG. 6, each latch 60 can include a main body 61 for housing a spring biased protrusion 62. The protrusion including a cross sectional dimension that is complementary to the diameter of each of the apertures 65 located along each of the lower vertical frame members 26-29. In operation, when a user depresses the button 53, the link retracts the protrusion 62 (see arrow a), thus allowing the upper frame section to move vertically relative to the middle and lower horizontal frame sections. This movement corresponding to the suitcase being oriented at the small, medium and large configuration shown at FIGS. 1A/2, 1B/3 and 1C/4, respectively.

As noted above, the preferred embodiment of the suitcase 10 will include specific dimensions suitable for airline travel. Accordingly, the suitcase 10 will preferably include a height (e.g., distance between wheels 14 and the upper horizontal frame section) of 22 inches, a width (e.g., distance between the left and right side vertical frame sections) of 14 inches, and a depth (e.g., distance between the lower front and back frame members) of 9 inches. Such dimensions conforming to airline standards for carry-on baggage.

Likewise, the height of the suitcase 10 can expand to approximately 40 inches in the Medium configuration and 62 inches in the Large configuration. Such dimensions also conforming to airline industry size standards. Of course, other embodiments are contemplated wherein the suitcase 10 includes different dimensions.

Accordingly, the above described adjustable sized suitcase 10 functions to allow a user to quickly and easily adjust the size of their luggage to suit any situation and therefore avoid expensive airline fees when in the carry-on configuration.

As described herein, one or more elements of the adjustable size suitcase 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An adjustable size suitcase, comprising:

a main body having a top section, a middle section and a bottom section that define a hollow interior space;

at least one flap that is disposed along an outside portion of the main body, said flap being configured to selectively allow access to the hollow interior space;

a frame that is positioned within the hollow interior space, said frame including an upper frame assembly, a middle frame assembly and a lower frame assembly;

said upper frame assembly including an upper front horizontal frame member, an upper back horizontal frame member, and a pair of upper side horizontal frame members;

said lower frame assembly including a lower front horizontal frame member, a lower back horizontal frame member and a pair of lower side horizontal frame members;

said middle frame assembly including a middle back horizontal frame member a pair of middle side horizontal frame members, and an open front end;

a grip supported by a plurality of central frame members, wherein the plurality of central frame members are supported by the pair of upper side horizontal frame members;

an actuator positioned along the grip;

a plurality of latches positioned within plurality of vertical frame members of the lower frame assembly; and a plurality of cables coupling the actuator with the plurality of latches;

wherein the at least one flap is positioned across the open front end of the middle frame assembly, and is configured to access a portion of the hollow interior space defined by both the upper frame assembly and the middle frame assembly, wherein each of the main body and the frame include functionality for transitioning between a first size, a second size and a third size upon activation of the actuator.

2. The suitcase of claim 1, wherein the middle section of the main body is collapsible.

3. The suitcase of claim 1, wherein the upper frame assembly is slidingly engaged to the lower frame assembly.

4. The suitcase of claim 1, wherein the first size comprises an airline standard carry-on size.

5. The suitcase of claim 1, further comprising:

a handle that is disposed along a back side of the main body and that is in communication with the frame.

6. The suitcase of claim 5, wherein the handle includes an adjustable length.

7. The suitcase of claim 6, wherein the handle is configured to adjust length when the frame is transitioned to each of the first size, the second size and the third size.

8. The suitcase of claim 1, further comprising:

a plurality of wheels that are disposed along a bottom surface of the main body and are in communication with the lower frame assembly.

9. The suitcase of claim 1, wherein each latch, in the plurality of latches, comprises a spring biased protrusion positioned within a main body.

10. The suitcase of claim 1, wherein the grip is positioned between the upper front horizontal frame member and the upper back horizontal frame member.

* * * * *